US009995073B2

(12) United States Patent
Svenson et al.

(10) Patent No.: US 9,995,073 B2
(45) Date of Patent: Jun. 12, 2018

(54) FOLDING DOOR TROLLEY

(71) Applicants: Julian Michael Svenson, Cornwall (CA); Craig McMartin, Ingleside (CA)

(72) Inventors: Julian Michael Svenson, Cornwall (CA); Craig McMartin, Ingleside (CA)

(73) Assignee: Dynamic Closures Corporation, Long Sault (CA)

( * ) Notice: Subject to any disclaimer, the term of this patent is extended or adjusted under 35 U.S.C. 154(b) by 28 days.

(21) Appl. No.: 14/544,689

(22) Filed: Feb. 3, 2015

(65) Prior Publication Data

US 2015/0233163 A1 Aug. 20, 2015

(30) Foreign Application Priority Data

Feb. 10, 2014 (CA) ..... 2842446

(51) Int. Cl.
*E05D 15/06* (2006.01)
*E05D 15/26* (2006.01)

(52) U.S. Cl.
CPC ..... *E05D 15/26* (2013.01); *E05D 15/06* (2013.01); *Y10T 16/364* (2015.01)

(58) Field of Classification Search
CPC ... E05D 15/0626; E05D 15/063; E05D 15/26; Y10T 16/324; A47H 15/00; A47H 15/02; A47H 15/04
USPC ..... 160/113, 118, 123, 124, 126, 196.1–200; 16/87 R, 91, 94 D, 96 D, 97, 98, 102, 16/106, 107
See application file for complete search history.

(56) References Cited

U.S. PATENT DOCUMENTS 871,386 A * 11/1907 Burkholder ..... E05D 15/0634 16/105
1,066,458 A * 7/1913 Wagner ..... E05D 15/0634 16/103
1,169,568 A * 1/1916 Richards ..... E05D 15/063 16/103
1,191,334 A * 7/1916 Myers ..... E05D 15/0639 16/105
1,377,135 A * 5/1921 Kules ..... E05D 15/063 16/104
1,639,378 A * 8/1927 Knight ..... E05D 15/0643 16/88
1,761,215 A * 6/1930 Lamm ..... E05D 15/063 16/105
1,931,796 A * 10/1933 Hoffman ..... E05D 15/063 16/105
2,615,514 A 10/1952 Hickling
2,753,588 A * 7/1956 Grosh ..... A47H 15/02 16/95 R
2,807,058 A * 9/1957 Morgan ..... E05D 15/063 104/94
2,843,872 A 7/1958 Hannon
(Continued)

*Primary Examiner* — Katherine W Mitchell
*Assistant Examiner* — Johnnie A. Shablack
(74) *Attorney, Agent, or Firm* — George A. Seaby

(57) ABSTRACT

A trolley for use with a folding door to suspend the door from an overhead track. The trolley has a mounting post for use in connecting the trolley to a folding door with a cylindrical mounting axle extending from the post. The trolley has a wheel unit comprising a short wheel axle with a wheel rotatably mounted at each end. The wheel unit is mounted on the post with the mounting axle on the post extending through the wheel axle between the wheels. The post is rotatable relative to the wheel unit.

2 Claims, 2 Drawing Sheets

(56) References Cited

U.S. PATENT DOCUMENTS 2,922,183 A 1/1960 Taylor
3,003,551 A * 10/1961 Ferris ..... E05D 15/12 16/361
3,072,975 A * 1/1963 Burmeister ..... E04B 2/827 105/155
3,118,170 A * 1/1964 Zollinger ..... E05D 15/063 16/105
3,193,870 A * 7/1965 McNinch ..... E05D 15/063 16/105
3,287,759 A * 11/1966 Foltz ..... E05D 15/063 16/87 R
3,304,135 A * 2/1967 Hasselmark ..... E05D 15/063 16/98
3,392,420 A 7/1968 Kless
3,424,225 A * 1/1969 Magnusson ..... A47H 1/104 16/95 D
3,428,999 A * 2/1969 Benson, Jr. ..... E05D 15/063 16/103
3,580,183 A * 5/1971 Nearman ..... B61B 13/04 104/108
3,585,674 A * 6/1971 Golden ..... A47H 13/00 16/87.6 R
3,708,827 A * 1/1973 Foltz ..... E05D 15/063 16/107
3,708,916 A * 1/1973 Karp, Jr. ..... E05D 15/0613 104/105
3,757,384 A * 9/1973 Rusch ..... E05D 15/063 16/223
3,793,673 A * 2/1974 Lawrence, Jr. ..... E05D 15/063 16/103
3,798,839 A * 3/1974 Kaufman ..... E05D 15/0613 160/199
3,829,929 A * 8/1974 Foltz ..... E05D 15/063 16/223
4,125,143 A * 11/1978 Pape ..... A47H 13/00 16/87.2
4,229,857 A * 10/1980 Toder ..... A47H 15/02 104/89
4,240,178 A * 12/1980 Miki ..... A47H 15/02 16/93 D
4,274,467 A 6/1981 Comeau
4,404,770 A 9/1983 Markus
4,457,046 A * 7/1984 Vater ..... E05D 15/063 105/155
4,473,102 A * 9/1984 Ohman ..... A47H 5/032 16/87.4 R
4,476,652 A 10/1984 Beauchot
4,525,893 A * 7/1985 Fukada ..... A47H 13/02 104/108
4,576,096 A * 3/1986 Toder ..... B61B 13/04 104/94
4,642,844 A * 2/1987 Johnston ..... E05D 15/063 105/155
4,675,939 A * 6/1987 Fukada ..... A47H 13/01 16/102
4,680,828 A 7/1987 Cook
4,702,175 A * 10/1987 Brudereck ..... B66C 13/12 105/154
4,837,891 A * 6/1989 Toma ..... E05D 15/0613 104/111
4,845,806 A * 7/1989 Hamacher ..... E05D 15/0613 104/94
4,846,249 A * 7/1989 Cooper ..... A47H 15/02 16/102
4,852,628 A 8/1989 Klein
4,915,153 A * 4/1990 Toti ..... A47H 1/04 160/330
4,957,600 A * 9/1990 Carlson ..... E05F 15/605 160/118
5,016,318 A * 5/1991 Harris ..... E05D 15/0608 16/94 R
5,035,025 A * 7/1991 Morris ..... E04B 2/827 16/95 R
5,042,555 A * 8/1991 Owens ..... E04B 2/827 160/116
5,063,636 A * 11/1991 Dickson ..... E05D 15/0613 16/106
5,085,150 A * 2/1992 Moore ..... B60B 33/00 104/89
5,085,262 A * 2/1992 Tutikawa ..... E05D 15/26 160/199
5,090,171 A * 2/1992 Kano ..... E04B 2/827 160/199
5,097,883 A * 3/1992 Robinson ..... E05D 15/26 160/118
5,109,910 A * 5/1992 Tortorella ..... A47H 15/04 160/197
RE34,360 E * 8/1993 Carlson ..... E06B 3/805 160/118
5,272,839 A 12/1993 Karhu
5,499,671 A * 3/1996 Owens ..... E05D 15/26 16/94 R
5,542,149 A * 8/1996 Yu ..... A47H 15/02 16/87.4 R
6,058,849 A * 5/2000 Ostholt ..... B66C 7/04 104/139
6,209,171 B1 * 4/2001 Pelletier ..... E05D 15/063 16/87 R
6,233,878 B1 * 5/2001 Krahenbuhl ..... E05F 15/632 49/409
6,321,821 B1 * 11/2001 Wunsche ..... E06B 9/364 160/178.1 V
6,374,456 B1 * 4/2002 Fort ..... E05D 15/0613 16/87.6 R
6,463,625 B2 * 10/2002 Mittag ..... E05D 15/0639 16/105
6,618,900 B2 * 9/2003 Spork ..... E05D 11/1007 16/102
6,745,813 B2 * 6/2004 Yorgason ..... E05D 15/063 16/87 R
6,866,078 B1 * 3/2005 Lin ..... E06B 9/362 160/177 V
6,935,403 B2 * 8/2005 Killo ..... A47H 1/04 16/87 R
6,983,512 B2 * 1/2006 De Oliveira ..... E05D 15/063 16/87 R
6,994,145 B2 * 2/2006 Killo ..... A47H 1/04 160/331
7,185,589 B2 * 3/2007 Owens ..... E05D 15/0608 104/89
7,377,011 B2 * 5/2008 Sakakura ..... A47H 13/04 16/87.2
7,430,832 B2 * 10/2008 Hung ..... E05F 1/16 16/72
7,552,755 B2 * 6/2009 Lin ..... E06B 9/36 160/168.1 V
7,578,096 B2 * 8/2009 Haab ..... E05F 15/638 16/87 R
7,788,769 B2 * 9/2010 Wicker ..... A47H 5/03 16/87 R
7,861,475 B2 * 1/2011 Sprague ..... E04B 2/827 160/196.1
8,046,872 B2 * 11/2011 Burgess, III ..... E05D 15/0639 16/103
8,215,061 B2 7/2012 Gosling
8,307,499 B2 * 11/2012 Ruffo ..... A47H 13/00 16/87.2
8,375,638 B2 * 2/2013 Martin ..... E04B 2/827 49/409
8,522,398 B2 * 9/2013 Haab ..... E05D 15/0634 16/102
8,584,317 B2 * 11/2013 Liebscher ..... E04B 2/827 16/91
8,590,233 B2 * 11/2013 Sprague ..... E04B 2/827 16/91
8,695,165 B2 * 4/2014 Pelekanos ..... E05D 15/26 16/105

(56) References Cited

U.S. PATENT DOCUMENTS 8,826,964 B2 * 9/2014 Goodman ..... E05D 15/26 160/118
8,844,604 B2 * 9/2014 Pelekanos ..... E05D 15/0656 16/87 R
8,850,659 B2 * 10/2014 Ewing ..... E05D 15/0634 16/105
8,857,015 B2 * 10/2014 Hufen ..... E05D 15/063 16/91
8,869,351 B2 * 10/2014 Chen ..... E05D 15/063 16/106
8,869,869 B2 * 10/2014 Graneto, III ..... A47H 1/04 160/330
8,925,149 B2 * 1/2015 Chuang ..... A47H 15/02 16/87.2
8,959,713 B2 * 2/2015 Lagarde ..... A47H 15/02 16/102
8,984,716 B2 * 3/2015 Proctor ..... E05D 15/063 16/97
9,032,588 B2 * 5/2015 Chen ..... E06B 7/28 16/106
9,038,240 B2 * 5/2015 Chen ..... E05D 15/063 16/106
9,125,509 B2 * 9/2015 Graneto, III ..... A47H 1/04
9,157,267 B2 * 10/2015 Pelekanos ..... E05D 15/26
9,624,708 B2 * 4/2017 Balay ..... E05D 15/24
2001/0011583 A1 * 8/2001 Spork ..... E05D 15/26 160/199
2004/0000026 A1 * 1/2004 Owens ..... A47H 15/02 16/97
2004/0000100 A1 * 1/2004 Owens ..... E04B 2/827 52/36.1
2004/0025292 A1 * 2/2004 Owens ..... E05D 15/0608 16/102
2007/0227074 A1 * 10/2007 Frank ..... E05D 15/063 49/409
2008/0196206 A1 * 8/2008 Chen ..... E05D 15/063 16/87 R
2008/0202706 A1 * 8/2008 Fath ..... E05D 15/26 160/199
2009/0289463 A1 * 11/2009 Tsai ..... E05D 15/26 292/341.15
2010/0006237 A1 * 1/2010 Claypool ..... E04B 2/827 160/201
2010/0101150 A1 * 4/2010 Huang ..... E05D 15/063 49/409
2011/0314634 A1 * 12/2011 Liebscher ..... E04B 2/827 16/91
2012/0031005 A1 * 2/2012 Liao ..... E05D 15/063 49/360
2013/0020035 A1 * 1/2013 Pelakanos ..... E05D 15/26 160/181
2014/0284005 A1 * 9/2014 Kao ..... A47H 13/14 160/84.06
2014/0338264 A1 * 11/2014 Pelekanos ..... E05D 15/26 49/425
2015/0000082 A1 * 1/2015 Lang ..... E05D 7/0027 16/248
2015/0047150 A1 * 2/2015 Saito ..... E05F 5/02 16/103
2015/0113769 A1 * 4/2015 Yu ..... A47H 15/02 16/93 R
2015/0247349 A1 * 9/2015 Terno ..... E05D 15/0652 49/409
2016/0024826 A1 * 1/2016 Smith ..... E05D 15/26 160/197
2016/0340953 A1 * 11/2016 Zimmer ..... E05D 15/063
2017/0172332 A1 * 6/2017 Legault ..... A47H 1/04

* cited by examiner

FOLDING DOOR TROLLEY

BACKGROUND OF THE INVENTION

1. Field of the Invention

The invention relates to a trolley for a folding door. A plurality of trolleys attached to the top of the folding door are used to suspend the door from an overhead track. The trolleys roll along the track and help the door to easily fold or unfold as required. The invention is also directed toward a folding door incorporating the trolleys.

2. Description of the Related Art

The prior art trolleys usually have a single wheel rotatably mounted on an axle. The axle is fixed to the top of a mounting post on the door, and extends from the post laterally relative to the direction the trolley travels. When the trolley is fixedly mounted on the top of a folding door, via the mounting post, the trolley wheel, offset to the side from the post, sits on an overhead track supporting the folding door off the ground. The door can often swing laterally to the side from the vertical plane it normally rests in while being opened or closed. Since the wheel axle is fixedly mounted to the trolley assembly and the trolley assembly is fixedly mounted to the door, if the door does swing laterally, the wheel will tilt and rub against a side of the track creating friction. The rubbing makes it harder to open or close the door and adds wear to the wheel. The door can also swing laterally while being moved around a curved section of track, centrifugal force swinging the door outwardly of the curve and tilting the trolley wheels on the curve inwardly to bear against the track, again making it harder to move the door.

SUMMARY OF THE INVENTION

It is the purpose of the present invention to provide a trolley for a folding door which will reduce friction when the door swings laterally while being opened or closed. It is another purpose of the present invention to reduce the width of the trolley to allow closer stacking of the panels of a folding door when the door is folded, while reducing friction. It is another purpose of the present invention to provide a folding door with trolleys that reduces friction when the door swings laterally while being opened or closed. It is a further purpose of the present invention to provide a folding door with trolleys that allows the panels of the door to be folded more compactly.

In accordance with the present invention, a trolley is provided having a mounting post with a cylindrical mounting axle extending transversely from the top of the post. The trolley has a wheel unit consisting of a wheel axle with a wheel rotatably mounted at each end. The wheel unit is rotatably mounted on the mounting axle on the post with a wheel on each side of the axle. The wheel unit is mounted on a track with two spaced-apart running surfaces for the wheels with the post hanging from the unit between the running surfaces. The hanging post is fixed to a folding door. If the door swings laterally during folding or unfolding, the post rotates about the mounting axle with the wheels remaining on the running surfaces. The wheel unit is not tilted and thus the unit does not rub any walls while moving. Friction in moving the door is reduced. The door is easier to move. Wear on the wheels is also reduced. The trolley is relatively narrow compared to trolleys mounting the wheel laterally. The narrow trolleys permit the door panels to stack closer together when folded because the trolleys do not interfere with the door panels. Closer stacking can result in cost savings since less storage space is required to hold the folded closures.

The invention is particularly directed toward a trolley for use with a folding door to suspend the door from an overhead track. The trolley has a mounting post for use in connecting the trolley to a folding door and a cylindrical mounting axle extending from the top of the post. A wheel unit comprising a short wheel axle with a wheel rotatably mounted at each end is rotatably mounted on the mounting axle on the post, the mounting axle extending through the wheel axle between the wheels.

The invention is also directed to a folding door installation using the trolleys. The installation includes a folding door, an overhead track, and the trolleys of the present invention mounted on the top of the door and suspended from the track.

DESCRIPTION OF PREFERRED EMBODIMENT

Figure 1:
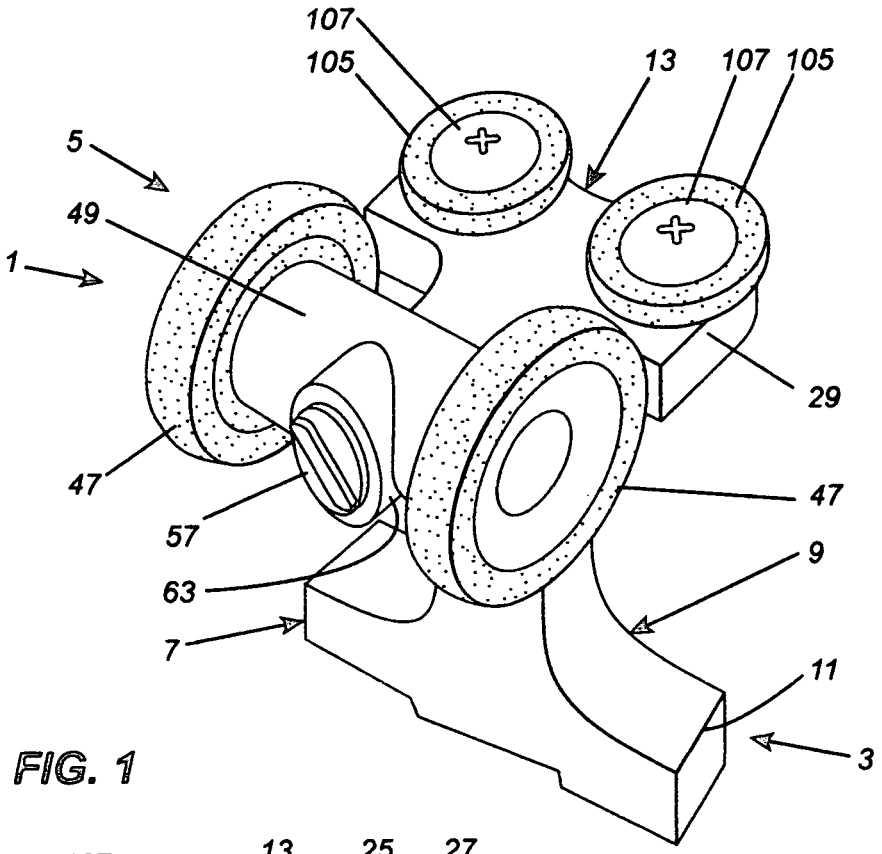
FIG. 1 is a perspective view of the trolley.
Figure 2:
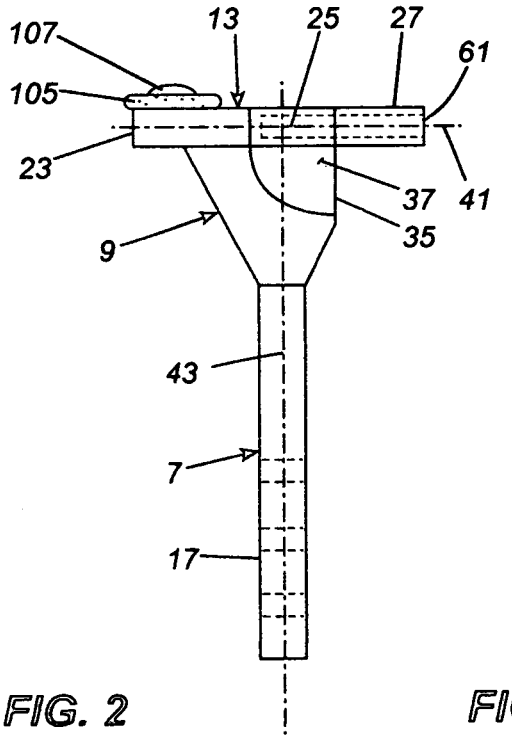
FIG. 2 is a side view of the post in the trolley.

The trolley 1, as shown in FIGS. 1-5, has a mounting post 3 with a wheel unit 5 mounted on the top of the post 3. The mounting post 3 has an elongated stem 7 with a transition section 9 at the top 11 of the stem 7 joining the stem to the bottom of a plate-like cap 13. The cap 13 extends transverse to the stem 7. The stem 7 can have a rectangular cross-section with a series of spaced-apart, threaded, mounting holes 15 along its length extending between the wide sides 17 of the stem. The transition section 9 narrows down, moving up from the top 11 of the stem 7, to a thin neck area 19 and then widens again to substantially the width of the cap 13 before connecting to it. At the same time, the transition section 9 will thicken slightly both forwardly and rearward to become thicker than the stem before connecting to the bottom of the cap 13.

Figure 3:
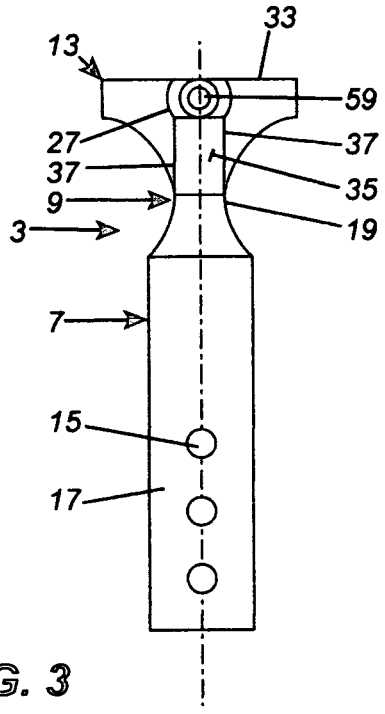
FIG. 3 is a front view of the post in the trolley.
Figure 4:
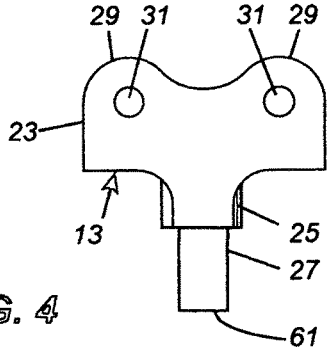
FIG. 4 is a top view of the post in the trolley.

The cap 13 has a rear section 23 of slightly less width than the width of the track the trolley rides on, and a narrower front section 25 extending forwardly from the front of the rear section 23. The front section 25 is flat on top and partly rounded from the top down as shown in FIGS. 3 and 4. A cylindrical mounting axle 27 extends forwardly from the center of the front section 25. The rear corners 29 of the rear section 23 have mounting holes 31 extending down from the top 33 of the cap 13 through the section 23. The holes 31 are used to mount guide wheels on the top of the rear section 23 as will be described. The upper front portion of the transition section 9 is cut away on each side to provide a narrow front section 35 having flat parallel sides 37, the front section 35 about the width of the mounting axle 27 and directly below and behind the axle. The longitudinal axis 41 of the mounting axle 27 is perpendicular to the longitudinal axis 43 of the stem 7. The post 3 is a single molded unit with the stem 7, the transition section 9 and the cap 13 unitary.

Figure 6:
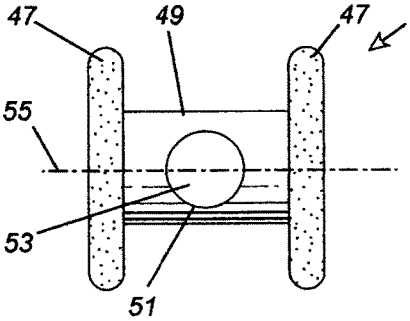
FIG. 6 is a front view of the wheel unit in the trolley.

The trolley 1 includes a wheel unit 5. The wheel unit 5, as shown in FIGS. 1 and 6, comprises a pair of wheels 47, one at each end of a short wheel axle 49. The wheel axle 49 has a cylindrical bore 51 extending transversely through it, the bore 51 centrally located between the wheels 47. The longitudinal axis 53 of the bore 51 is perpendicular to the longitudinal axis 55 of the wheel axle 49. The wheel unit 5 is mounted on the mounting axle 27 of the post 3, the mounting axle 27 passing snugly through the bore 51 in the wheel axle 49. The mounting axle 27 is slightly longer than the diameter of the wheel axle 49. The narrow front section 35 of the cap 13 permits the wheel unit 5 to be narrow allowing the folding door panels to stack together more closely. A screw or like fastener 57 can be threaded into a hole 59 in the free end 61 of the mounting axle 27 with a head or washer 63 large enough to retain the wheel unit 5 on the mounting axle 27 snugly between the fastener 57 and the front section 35 of the cap 13 on the mounting post 3. The mounting post 3, through its mounting axle 27 rotatably mounted in the wheel unit 5, can rotate relative to the wheel unit 5 about the longitudinal axis 41 of the mounting axle 27. The narrow front section 35 on the transition section 9 is spaced sufficiently from the wheels 47 to allow limited rotation of the post.

Figure 7:
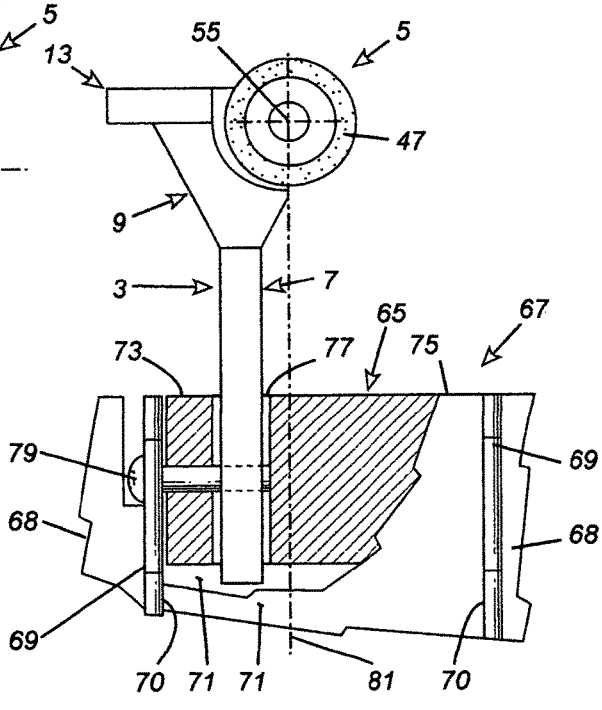
FIG. 7 is a side view, partly cut-away, of the trolley mounted in a folding door post.

The trolley 1 is mountable on a support post 65, as shown in FIG. 7, in a folding door 67, only a section of which is shown. The support post 65 is mounted between two vertical panels 68, the panels connected to the support post by hinges 69. The support post 65 has two opposed end panels 70 joined by two opposed side panels 71. One or the other end panel 70 is a leading or front panel depending on which direction the post 65 travels. The support post 65 has a mounting block 73 at its top end 75 with a slot 77 in the block 73. The trolley 1 is mounted on the mounting block 73 by passing the stem 7 of the mounting post 3 through the slot 77. When the trolley 1 is mounted on the block 73, the mounting axle 27 on the mounting post 3 extends horizontally in a direction toward one of the end panels 70 of the support post 65. A threaded fastener 79 can be mounted through the block 73 to extend into the slot 77. The fastener 79 can be passed through one of the holes 15 in the stem 7, which holes are threaded, to retain the trolley 1 on the support post 65. The series of holes 15 in the stem 7 allows the height of the wheel unit 5 of the trolley 1 above the top end 75 of the support post 65 to be adjusted. The slot 77 is laterally offset from the longitudinal axis 81 of the support post 65 a distance to have the rotational axis 55 of the wheels 47 of the trolley 1 aligned with the longitudinal axis 81 of the support post 65 resulting in less stress applied to the wheel unit 5.

Figure 8:
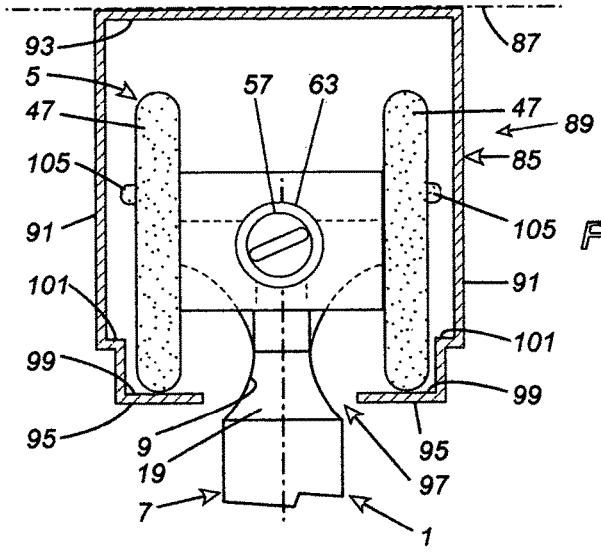
FIG. 8 is a cross-section view of a door trolley mounted in an overhead track.

As shown in FIG. 8, a track 85 for the trolleys 1 on the folding door is fastened to the top 87 of the door opening 89. The track 85 has an inverted u-shape in cross-section with side walls 91 joined by a top wall 93. The top wall 93 of the track 85 is fastened to the top 87 of the opening 89 by suitable fastening means. The track 85 has wheel support flanges 95 extending inwardly toward each other from the bottom of the side walls 91 extending down from the top wall 93. A central gap 97 is provided between the wheel support flanges 95. The top of the flanges 95 provide running surface 99 for the wheels 47 on the trolley 1. With the wheels 47 on the running surfaces 99, the stem 7 of the post 3 of the trolley 1 extends down to the door beneath the track 85, through the gap 97 between the flanges 95. The thin neck area 19 of the post 3 is aligned with the flanges 95, the neck area being narrower than the gap 97 between the flanges 95.

Figure 5:
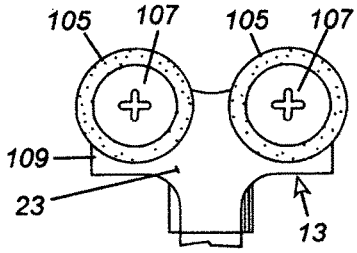
FIG. 5 is a top view of the post with guide wheels.

The side walls 91 of the track 85 may have narrow shoulders 101 extending part way up from the bottom of the side walls 91 to limit contact the wheels 47 of the trolley 1 may make with the side walls 91. Only a small part of the wheels 47 would contact the shoulders 101 if the wheel unit 5 moves slightly sideways in the track 85. The post 3 can also carry guide means on the cap 13 as shown in FIG. 5. The guide means can comprise two small discs 105, one each mounted adjacent a rear corner 29 of the cap 13. The disks 105 rest flat on the top 33 of the cap 13 and are rotatable about fastening means 107 connecting them to the cap 13. The fastening means 107, such as a screw, use the mounting holes 31 in the cap. Each disk 105 extends slightly past the side 109 of the cap 13 to be adjacent a side wall 91 of the track 85. If the wheel unit 5 has a tendency to move laterally while the door is being moved, the disc 105 on the side the unit 5 moves toward will contact and rotate against the side wall 91 of the track 85 to limit contact of the wheels 47 with the side walls 91.

The neck area 19 and the narrow front portion 35 of the transition section 9 provide room for the wheels 47 to be closely adjacent the longitudinal axis 43 of the stem 7 making the unit very compact. Even though the wheel unit 5 is compact, the shaping of cap 13 and the transition section 9 to provide a narrow front portion 35 with flat sides 37 provides room for the post 3, and thus the attached door, to swing about the mounting axle 27 on the wheel unit 5 in the track 85 without normally encountering the wheels 47. Thus the wheel unit 5 normally stays square on the running surfaces 99 instead of tilting into the walls 91.

The above description is meant to be exemplary only, and one skilled in the art will recognize that changes may be made to the embodiments described without departing from the scope of the invention disclosed. Modifications which fall within the scope of the present invention will be apparent to those skilled in the art. In light of a review of this disclosure, such modifications are intended to fall within the appended claims.

We claim:

1. A trolley for use with a folding door to suspend the door from an overhead track comprising a mounting post including an elongated stem having a top end, a bottom end for connecting the trolley to the folding door and a transition section at said top end of the stem, the transition section having a narrow neck joined to the top end of the stem and an upper end larger than the neck; a cap on the upper end of the transition section, the cap having a narrow front end and a wide rear end; a cylindrical mounting axle extending forwardly, from the narrow front end of the cap; a wheel unit mounted on said mounting axle, said wheel unit including a short wheel axle extending transversely of the front end of the cap and a wheel rotatably mounted on each end of the wheel axle for riding in the track, the mounting axle extending through the wheel axle between the wheels and having a longitudinal axis perpendicular to a longitudinal axis of the wheel axle, whereby the mounting cost and cap can rotate relative to the wheel unit about the longitudinal axis of the mounting axle; and guide disks on an upper surface of the rear end of the cap, the disks extending outwardly beyond sides of the rear end of the cap for limiting contact of the wheels with sides of the track.

2. The trolley as claimed in claim 1, wherein said stem is rectangular in cross section and includes a plurality of threaded mounting holes spaced apart along the bottom end thereof.

* * * * *